US009968976B2

(12) United States Patent
Klinger

(10) Patent No.: US 9,968,976 B2
(45) Date of Patent: May 15, 2018

(54) CONDUIT BENDER

(71) Applicant: Keith E. Klinger, Great Meadows, NJ (US)

(72) Inventor: Keith E. Klinger, Great Meadows, NJ (US)

( * ) Notice: Subject to any disclaimer, the term of this patent is extended or adjusted under 35 U.S.C. 154(b) by 0 days. days.

(21) Appl. No.: 15/470,124

(22) Filed: Mar. 27, 2017

(65) Prior Publication Data

US 2017/0274437 A1 Sep. 28, 2017

Related U.S. Application Data

(60) Provisional application No. 62/313,265, filed on Mar. 25, 2016.

(51) Int. Cl.

| | |
|---|---|
| ***B21D 7/14*** | (2006.01) |
| ***B21D 7/06*** | (2006.01) |
| ***B21D 7/022*** | (2006.01) |
| ***B21D 7/02*** | (2006.01) |

(52) U.S. Cl.

CPC ..... *B21D 7/063* (2013.01); *B21D 7/02* (2013.01); *B21D 7/022* (2013.01); *B21D 7/14* (2013.01)

(58) Field of Classification Search

CPC ..... B21D 7/063; B21D 7/022; B21D 7/02; B21D 7/14

USPC ..... 72/459

See application file for complete search history.

(56) References Cited

U.S. PATENT DOCUMENTS

| | | | |
|---|---|---|---|
| 865,569 | A | 9/1907 | Crafts |
| 1,075,837 | A | 10/1913 | Malo et al. |
| 1,247,729 | A | 11/1917 | Scribner |
| 1,514,467 | A | 11/1924 | Schonfield et al. |
| 1,640,426 | A | 8/1927 | Pike |
| 1,865,025 | A | 6/1932 | Lidseen et al. |
| 2,255,867 | A | 9/1941 | Wisckol |
| 2,403,420 | A | 7/1946 | Willingham |
| 2,436,776 | A | 2/1948 | Pearson et al. |
| 2,604,924 | A | 7/1952 | Blake et al. |
| 2,623,425 | A | 12/1952 | Shiley |
| 2,630,033 | A | 3/1953 | Stayer |
| 2,656,747 | A | 10/1953 | Lewin |
| 2,666,351 | A | 1/1954 | Lewin |
| 2,732,743 | A | 1/1956 | Hart |
| 2,804,791 | A | 9/1957 | Wheeler |
| 2,839,957 | A | 6/1958 | Buckwalter et al. |
| 2,847,705 | A | 8/1958 | Hellwig |
| 2,887,917 | A | 5/1959 | Kowal |
| 2,908,193 | A | 10/1959 | Gryniewicz |
| 2,908,317 | A | 10/1959 | Sadler |
| 2,932,225 | A | 4/1960 | Gardner |
| 2,953,048 | A | 9/1960 | Brown |
| 3,063,314 | A | 11/1962 | Benfield et al. |
| 3,075,568 | A | 1/1963 | Bright |

(Continued)

*Primary Examiner* — David B Jones

(74) *Attorney, Agent, or Firm* — Carter, Deluca, Farrell & Schmidt, LLP

(57) ABSTRACT

A conduit bender to assist with the bending of a conduit includes a lever defining a longitudinal axis and having a free end and a fixed end, a head assembly configured to receive a conduit to be bent, a rotary assembly operably coupling the fixed end of the lever to the head assembly such that the lever is pivotable relative to the head to a position corresponding to desired bend angle, and a level disposed at the free end of the rotary lever and aligned on the longitudinal axis such that the level indicates a level condition when a conduit is bent to the desired bend angle.

20 Claims, 10 Drawing Sheets

(56) References Cited

U.S. PATENT DOCUMENTS

| | | | |
|---|---|---|---|
| 3,194,038 | A | 7/1965 | Small et al. |
| 3,253,441 | A | 5/1966 | Benfield |
| 3,440,847 | A | 4/1969 | Mount |
| 3,448,602 | A | 6/1969 | Stanley et al. |
| 3,456,468 | A | 7/1969 | Crippen |
| 3,523,371 | A | 8/1970 | Mount |
| 3,590,617 | A | 7/1971 | Mount |
| 3,718,018 | A | 2/1973 | Benfield |
| 3,735,621 | A | 5/1973 | Dodge |
| 3,763,510 | A | 10/1973 | Graham |
| 3,906,778 | A | 9/1975 | Crouse |
| 3,926,028 | A | 12/1975 | Kowal |
| 4,009,602 | A | 3/1977 | Linguist |
| 4,052,881 | A | 10/1977 | Mount |
| 4,063,444 | A | 12/1977 | Vecho, Jr. |
| 4,196,610 | A | 4/1980 | Chilton |
| 4,269,056 | A | 5/1981 | Kozinski |
| 4,321,820 | A | 3/1982 | Nason |
| 4,403,496 | A | 9/1983 | Kowal |
| 4,425,784 | A | 1/1984 | D'Gerolamo |
| 4,428,216 | A | 1/1984 | Fling |
| 4,442,695 | A | 4/1984 | Gardner |
| 4,452,064 | A | 6/1984 | Custin |
| 4,587,832 | A | 5/1986 | Illguth |
| 4,622,837 | A | 11/1986 | Bergman |
| 4,691,555 | A | 9/1987 | Vaughan |
| 4,829,806 | A | 5/1989 | Wright |
| 4,879,816 | A | 11/1989 | Sierk |
| 5,275,031 | A | 1/1994 | Whiteside et al. |
| 5,459,934 | A | 10/1995 | Heroux |
| 5,655,309 | A | 8/1997 | Hadrami |
| 5,669,258 | A | 9/1997 | Luebke |
| 5,727,419 | A | 3/1998 | Walsten |
| 5,927,141 | A | 7/1999 | Walsten |
| 6,209,371 | B1 | 4/2001 | Guinn |
| 6,422,054 | B1 | 7/2002 | White |
| 6,446,483 | B1 | 9/2002 | Ericksen |
| 6,834,527 | B2 | 12/2004 | Hopwood |
| 6,920,700 | B2 | 7/2005 | Ekdahl et al. |
| 7,143,629 | B1 | 12/2006 | Chiu |
| 7,328,601 | B1 | 2/2008 | King |
| 7,475,580 | B1 | 1/2009 | Page |
| 7,624,511 | B1 | 12/2009 | Schmidt |
| 7,624,607 | B2 | 12/2009 | King |
| 7,707,733 | B1 | 5/2010 | Crain et al. |
| 7,886,565 | B2 | 2/2011 | Hainzinger et al. |
| 7,900,495 | B2 | 3/2011 | Latoria |
| 8,171,765 | B2 | 5/2012 | Rusch |
| 8,307,691 | B1 | 11/2012 | Bolander |
| 2004/0069043 | A1 | 4/2004 | Bates et al. |
| 2008/0189967 | A1 | 8/2008 | Tosa |
| 2010/0139110 | A1 | 6/2010 | Germain |

CONDUIT BENDER

CROSS-REFERENCE TO RELATED APPLICATIONS

This application claims the benefit of U.S. Provisional Application No. 62/313,265, filed on Mar. 25, 2016, the entire contents of which are hereby incorporated herein by reference.

BACKGROUND

Technical Field

The present disclosure relates to a conduit bender configured to facilitate bending of a conduit to a desired angle in a reliably repeatable fashion without the need for separate devices or instruments or making calculations. More particularly the present disclosure relates to conduit benders including a level, pre-defined markings (for different angle bends and/or different bend types), and/or a pivotable head to facilitate forming precise bends, e.g., offset bends, saddle bends, and/or 90 degree bends, in a conduit without the need for additional devices, additional instruments, or for making calculations.

Background of the Disclosure

Conduit benders are used to facilitate bending conduits to a desired angle. A typical conduit bender may include a lever and a head attached to the lever. However, typical conduit benders require the use of additional devices or instruments, calculations to be made, and/or consultation of a table in order to determine the bend points and angles required to achieve a particular bend or bends. Use of additional devices or instruments, performing calculations, and/or consulting tables adds to the time and labor required for bending conduits. This is particularly burdensome, for example, with respect to electricians, who may be required to bend large quantities of conduits at different bend angles and/or with different bend types.

SUMMARY

Provided in accordance with aspects of the present disclosure is the conduit bender including a rotary lever defining a longitudinal axis and having a free end and a fixed end, a head assembly configured to receive a conduit to be bent, a rotary assembly operably coupling the fixed end of the lever to the head assembly such that the lever is pivotable relative to the head to a position corresponding to a desired bend angle, and a level disposed at the free end of the rotary lever and aligned on the longitudinal axis such that the level indicates a level condition when a conduit is bent to the desired bend angle.

In an aspect of the present disclosure, the level is a spirit level disposed within the free end of the lever.

In another aspect of the present disclosure, the lever includes at least one set of markings corresponding to a particular bend angle. Each set of markings includes a first mark and a plurality of incremental markings extending along at least a portion of a length of the lever. Each set of markings is configured to facilitate offset bending of a conduit to navigate around an object in accordance with the particular bend angle. In aspects, the lever includes at least two sets of markings, each corresponding to a different particular bend angle.

In yet another aspect of the present disclosure, the lever includes at least one set of markings corresponding to a particular saddle bend height, wherein each set of markings includes first, second, and third markings extending along at least a portion of a length of the lever, the first, second, and third markings configured to facilitate saddle bending of a conduit in accordance with the particular saddle bend height.

In still another aspect of the present disclosure, the head assembly includes an extending member and a head.

In still yet another aspect of the present disclosure, the head assembly includes a shoe bender at a first end thereof.

In another aspect of the present disclosure, the head assembly defines a channel configured to receive a conduit to be bent.

In yet another aspect of the present disclosure, the head assembly includes a receiver at a second end thereof.

In still another aspect of the present disclosure, the head assembly defines an arcuate configuration including angular indicator markings.

In still yet another aspect of the present disclosure, the head assembly includes indentation markings corresponding to a bend center for each of a plurality of bend angles.

In another aspect of the present disclosure, the rotary assembly includes indicator markings and is configured to enable releasable locking of the lever in a plurality of different positions relative to the head assembly.

Another conduit bender provided in accordance with the present disclosure includes a lever defining a longitudinal axis and having a free end and a fixed end, and a head assembly coupled to the fixed end of the lever and configured to receive a conduit to be bent for bending the conduit. The lever includes at least one first set of markings corresponding to a particular bend angle. Each first set of markings includes a first mark and a plurality of incremental markings extending along at least a portion of a length of the lever. Each first set of markings is configured to facilitate offset bending of a conduit to navigate around an object in accordance with the particular bend angle. The lever further includes at least one second set of markings corresponding to a particular height saddle bend. Each second set of markings includes first, second, and third markings extending along at least a portion of the length of the lever. Each second set of markings is configured to facilitate saddle bending of a conduit to the particular height saddle bend. These first and second sets of markings enable bending without the need for additional instruments or devices, calculations, or consulting tables. The conduit bender may further include any of the aspects and/or features of the other conduit benders detailed hereinabove or hereinbelow, and vice versa.

BRIEF DESCRIPTION OF THE DRAWINGS

Aspects and features of the present disclosure are described herein with reference to the accompanying drawings, wherein.

DETAILED DESCRIPTION

Figure 1:
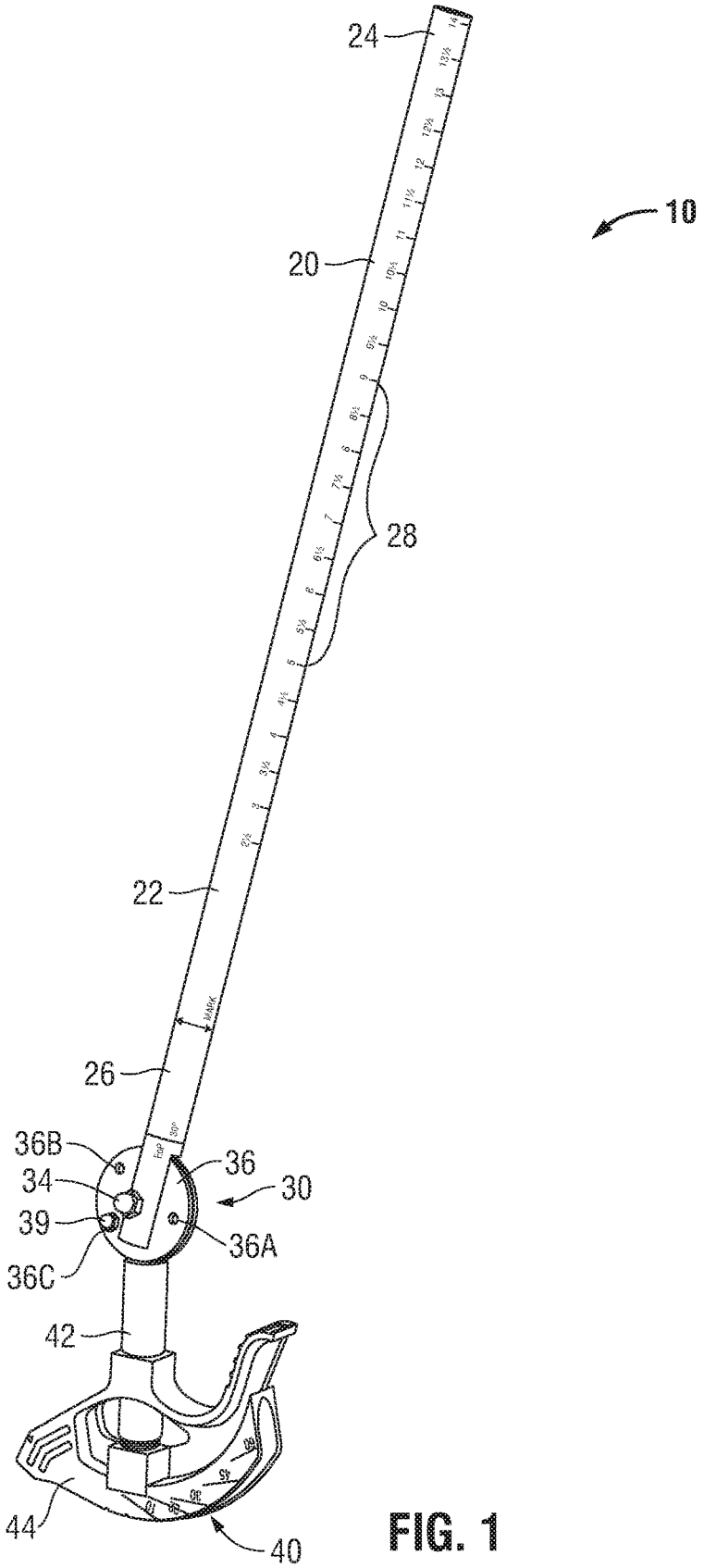
FIG. 1 is an perspective view of a conduit bender provided in accordance with aspects of the present disclosure.

Various embodiments of the present disclosure will now be described in detail with reference to the drawings, wherein like reference numerals identify similar or identical elements. In the following description, well known functions or constructions are not described in detail to avoid obscuring the present disclosure. To the extent consistent, any of the aspects and/or features of any of the embodiments detailed herein may be used in conjunction with any of the aspects and/or features of any of the other embodiments detailed herein.

Figure 4:
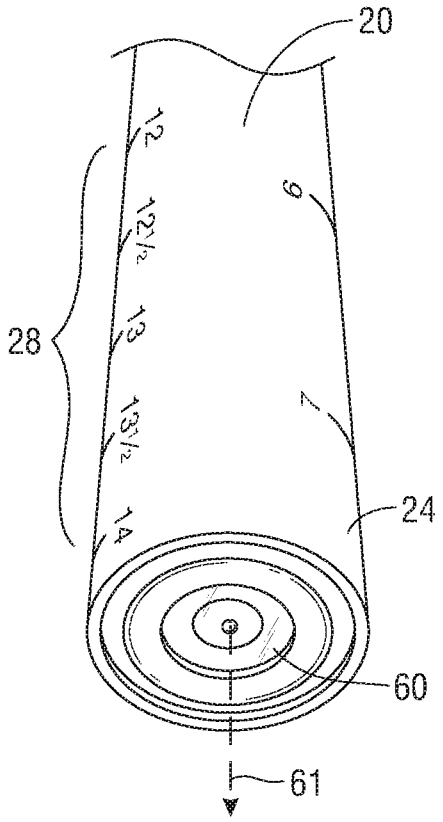
FIG. 4 is an end view from the free end of the rotary lever of FIG. 2.
Figure 5:
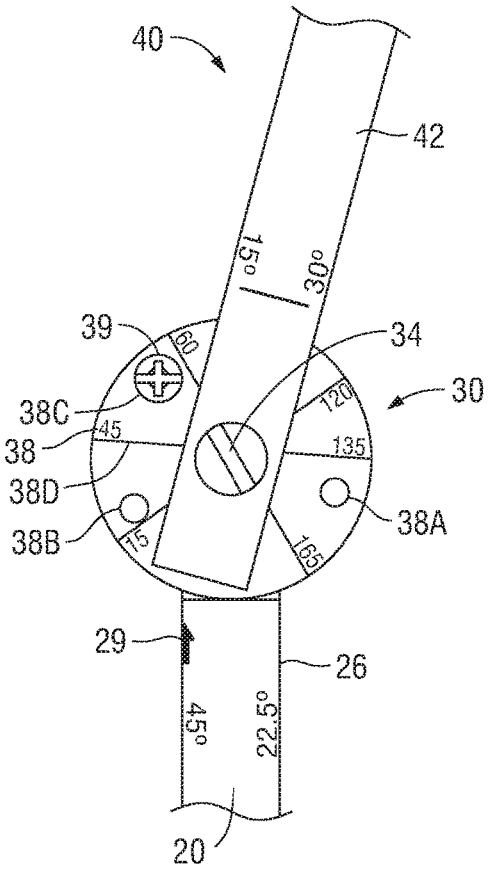
FIG. 5 is a top view of the rotary assembly of the conduit bender of FIG. 1.

Turning to FIG. 1, a conduit bender provided in accordance with the present disclosure is generally identified by reference numeral 10. Conduit bender 10 includes a rotary lever 20, a rotary assembly 30, a head assembly 40, and a spirit level 60 (FIG. 4). Conduit bender 10 may be made from plastic, composite material, aluminum, cast iron, other suitable materials, or combinations thereof. Rotary lever 20 is pivotable relative to head assembly 40 about rotary assembly 30.

Figure 2:
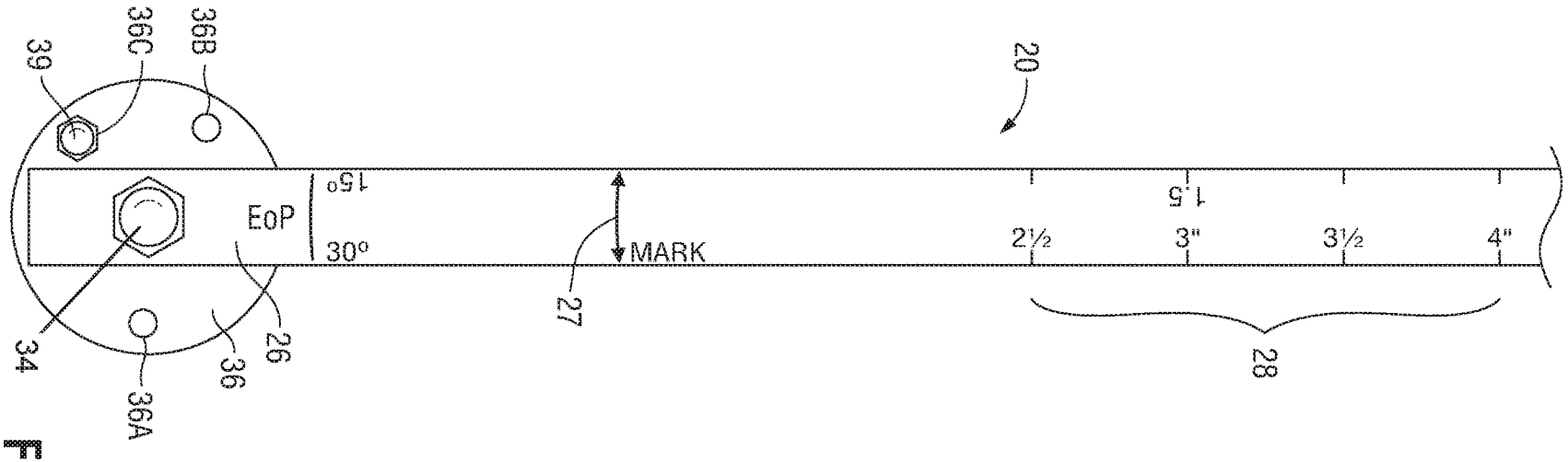
FIG. 2 is a top view of the rotary lever of the conduit bender of FIG. 1.
Figure 3A:
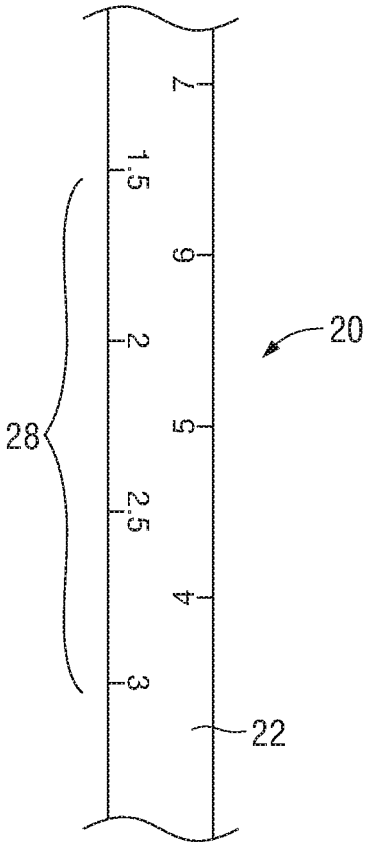
FIG. 3A is a top view of a portion of the rotary lever of FIG. 2.

Referring to FIGS. 2, 3A, and 4, rotary lever 20 defines a tubular configuration of rigid construction and includes an annular outer surface 22, a free end 24, and a fixed end 26. Rotary lever 20 of conduit bender 10 includes at least one set of markings. Where multiple sets of markings are provided, each set may be disposed at a different radial position about outer surface 22, and/or may be disposed at different longitudinal positions, e.g., on different longitudinal sections of outer surface 22 or disposed in offset, overlapping relation. Each set of markings corresponds to a particular bend angle and/or a particular type of bend. For example, where 15 degree offset bend angles are desired, a first set of markings may be utilized; where 30 degree offset bend angles are desired, a second set of markings may be utilized, etc. Each set of markings includes a first mark 27 and a plurality of incremental markings 28 extending along the length of outer surface 22. First mark 27 and incremental markings 28 allow rotary lever 20 to serve the additional function of a setting device to allow a user to mark the conduit to be bent at the precise bend points for the particular bent type and configuration, as detailed below with respect to FIGS. 10A-10G. As can be appreciated, rotary lever 20 may thus be used to facilitate marking of the conduit to be bent to ensure that bending occurs in the appropriate location(s), and without the need for additional devices or instruments, making calculations, and/or consulting tables. As also detailed below, the conduit benders of the present disclosure also enable a user to accurately achieve a desired bend or bends without additional devices or instruments.

Figure 3B:
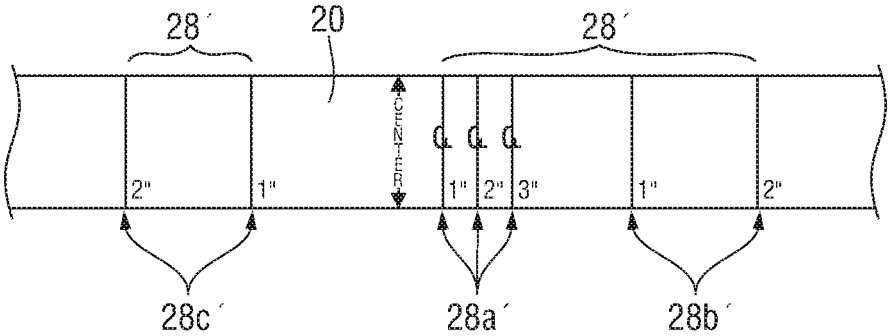
FIG. 3B is a top view of another portion of the rotary lever of FIG. 2.

Referring momentarily to FIG. 3B, another set of markings 28' that may be incorporated into rotary lever 20, in addition to or as an alternative to the above-noted markings, is detailed. Markings 28' are utilized to make saddle or three-point bends of a particular height. As can be appreciated, although shown for 1, 2, and 3 inch saddle heights and 15/30/15 bend angles, markings 28' may be provided for any suitable height(s) and/or angle(s) of saddle bend(s). Markings 28' are based off a center line (labeled "CENTER" in FIG. 3B) of the desired saddle bend and include a first markings 28*a*' corresponding to the first bend (of 30 degrees), second markings 28*b*' corresponding to the second bend (of 15 degrees), and third markings 28*c*' corresponding to the third bend (of 15 degrees). By using the markings 28' for the particular height bend, a user need only make the three markings and bend the conduit to the appropriate angle at each marking. As detailed below, the conduit benders of the present disclosure enable a user to accurately achieve the desired bend angles without additional devices or instruments.

Figure 6:
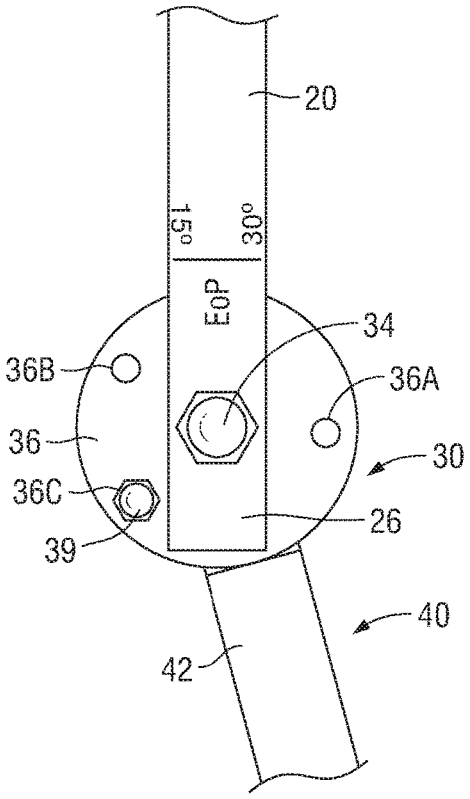
FIG. 6 is a bottom view of the rotary assembly of FIG. 5.

Referring to FIGS. 2-5, rotary lever 20 further includes a marking 29 towards fixed end 26 thereof. Marking 29 is provided to define an angle in combination with markings 38D of disk 38 and/or similar markings (not shown) of disk 36 (FIG. 6). Fixed end 26 of rotary lever 20 is fixedly engaged to disk 36 (FIG. 6) of rotary assembly 30, as detailed below.

Spirit level 60, as shown in FIG. 4, is recessed into the free end 24 of rotary lever 20 and may be secured therein in any suitable fashion, for example, using friction fit, internal screws, glue, etc., or may be removable from rotary lever 20. Spirit lever 60 is aligned on and coaxial with a longitudinal axis 61 define by rotary lever 20. The function of spirit level 60 is detailed below.

Referring to FIGS. 1 and 5-7, rotary assembly 30 includes a swivel pin 34, disks 36, 38, and one or more fastening bolts 39. Fixed end 26 of rotary lever 20 is secured, for example, welded, fastened, etc., to disk 36, while head assembly 40 is secured to disk 38 in a similar fashion or any other suitable manner. Swivel pin 34 pivotably couples disks 36, 38 to one another, thereby pivotably coupling rotary lever 20 and head assembly 40. Swivel pin 34 can be kept in place by using nuts, bolts, screws, etc. Disk 36 defines a plurality of radial apertures 36A, 36B, and 36C. Disk 38 likewise defines a plurality of radial apertures 38A, 38B, and 38C. Disks 36 and 38 can be fixed relative to one another using the above-mentioned apertures 36A-C and/or 38A-C in combination with one or more fastening bolts 39. Thus, rotary lever 20 may be fixed at a desired angle relative to head assembly 40.

Angular indicator markings 38D may be located on disk 36 and/or disk 38. Markings 38D enable conduit bender 10 to be set to a desired anticipated bend angle. More specifically, marking 27 and markings 38D may be utilized such that a user may pivot rotary lever 20 until marking 27 is aligned with the marking 38D corresponding to the desired anticipated bend angle. Thereafter, disks 36, 38 may be engaged with one another using apertures 36A-C, 38A-C and/or bolts 39 to maintain the desired anticipated bend angle. The function and benefit of this pre-setting configuration is detailed below.

Figure 7:
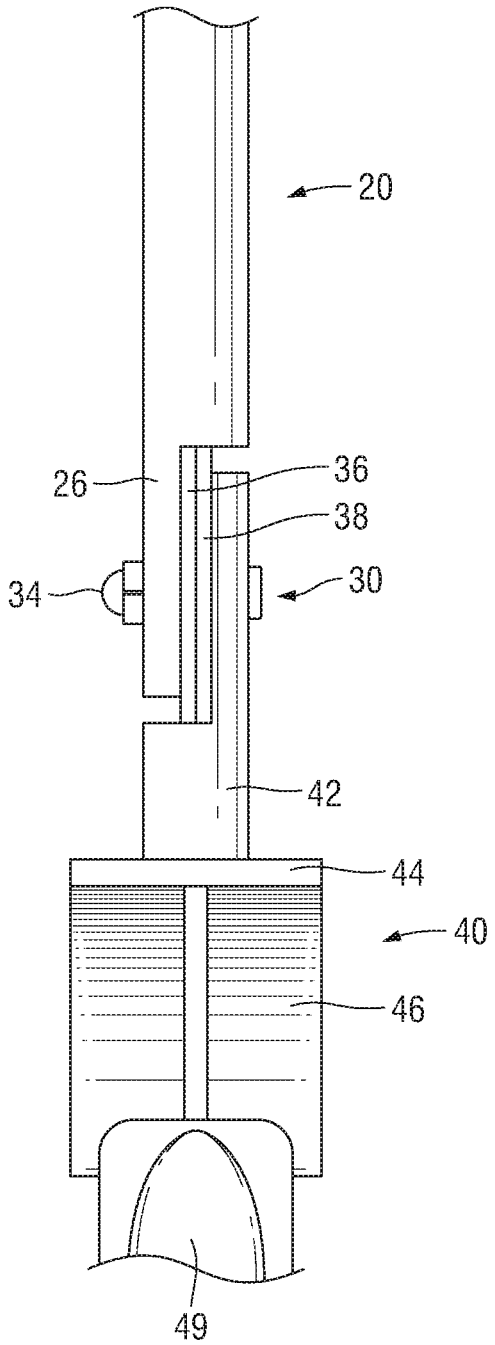
FIG. 7 is a side view of the rotary assembly of FIG. 5.
Figure 8:
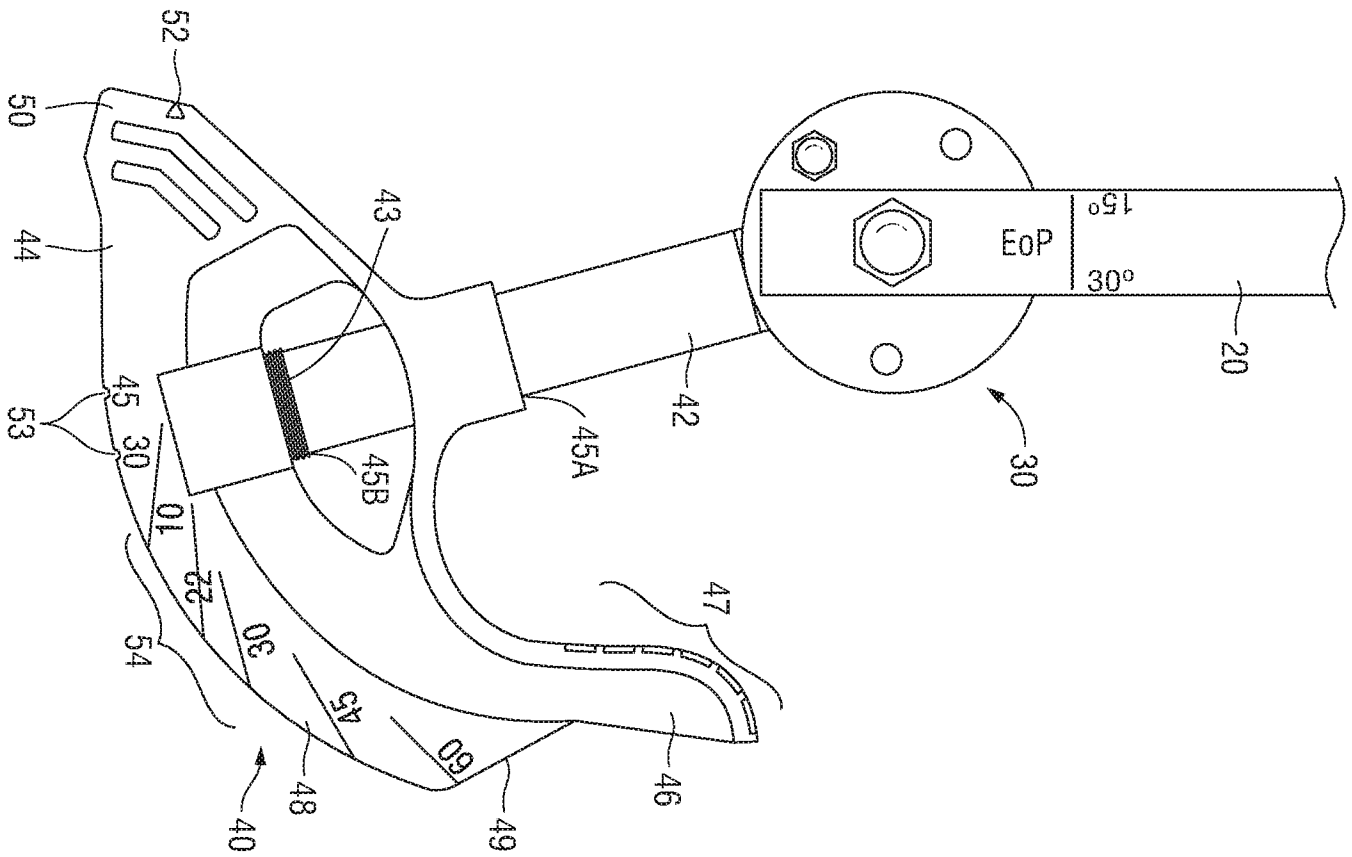
FIG. 8 is a top view of the head assembly and rotary assembly of the conduit bender of FIG. 1.

With reference to FIGS. 1, 7, and 8, head assembly 40 includes an extending member 42 and a rigid head 44. Extending member 42 is secured, for example, welded, fastened, etc., to disk 38. Extending member 42 extends through a first opening 45A of head 44 and is fixedly engaged to head 44 by a threaded fastener 43 engaged within a threaded second opening 45B of head 44.

Head assembly 40 further includes a shoe bender 46 positioned at a rear end of head 44. Shoe bender 46 defines a non-slip feature 47 configured to facilitate placement of a user's shoe thereon and inhibit slippage during bending. Head 44 further defines an arcuate body 48 having a channel 49 configured to receive a conduit to be bent. Body 48 defines a receiver 50 at the front end thereof that is configured to receive and retain a conduit to be bent. Receiver 50 communicates with channel 49 to enable a conduit to be bent to pass through receiver 50 and at least partially into channel 49, while maintaining the conduit in position such that bending about receiver 50 may be accomplished. A marking 52 is disposed adjacent receiver 50 of arcuate body 48 of head 44 to denote the point at which the conduit received within head assembly 40 will be bent. Increasing angular markings 54 are disposed on arcuate body 48 and indicate the bend angle of the conduit relative to marking 52 as the conduit is being bent. Head 44 further includes indentation markings 53 that indicate the point on the conduit corresponding to the center of the bend for the particular angle of bend, e.g., 30 degrees or 45 degrees. As noted below with respect to FIG. 9, additional indentation markings may be provided for different bend angles, e.g., 15 degrees, 22.5 degrees, 30 degrees, and 45 degrees.

Referring generally to FIGS. 1-8, in use for bending a conduit, after appropriate marking(s) on the conduit have been made to identify the bend points (as detailed below with respect to FIGS. 10A-10G), rotary lever 20 is first pivoted relative to head assembly 40 to the anticipated bend angle, as confirmed by alignment of marking 27 and the marking 38D corresponding to the anticipated bend angle. Thereafter, disks 36, 38 are engaged with one another using one or more of apertures 36A-C, 38A-C and one or more bolts 39, to fix rotary lever 20 at the anticipated bend angle. Next, the conduit to be bent is inserted through receiver 50 of body 48 of head 44 of head assembly 40 until the first bend point marking made on the conduit is aligned with marking 52. Depending upon the desired bend angle, the center of the resultant bend can be confirmed using the corresponding indentation marking 53. Finally, the conduit is bent by manipulating conduit bender 10 relative to the conduit, e.g., using shoe bender 46 or in any other suitable fashion. If required, a second, third, etc. bend may then be made in a similar fashion as detailed above, except with that bend marking point marking made on the conduit aligned with marking 52.

Achieving a desired bend angle during bending of the conduit can be achieved using angular markings 54 and/or spirit level 60. With respect to spirit level 60, with rotary lever 20 pre-set to the desired anticipated bend angle as noted above, the user can manipulate the conduit bender 10 to bend the conduit until spirit level 60 indicates that a level condition has been achieved. This level condition of spirit level 60 indicates that the conduit has been bent to an angle corresponding to the pre-set anticipated bend angle. Thus, the user can ensure that the desired angle has been achieved. Where spirit level 60 is not desired to be used, rotary lever 20 may be pivoted relative to head assembly 40 to an angle appropriate to enable use of conduit bender 10 in a confined area, and bending may be accomplished with verification via angular markings 54. Thus, the additional function of being able to alter conduit bender 10 for use in confined areas is realized.

Figure 9:
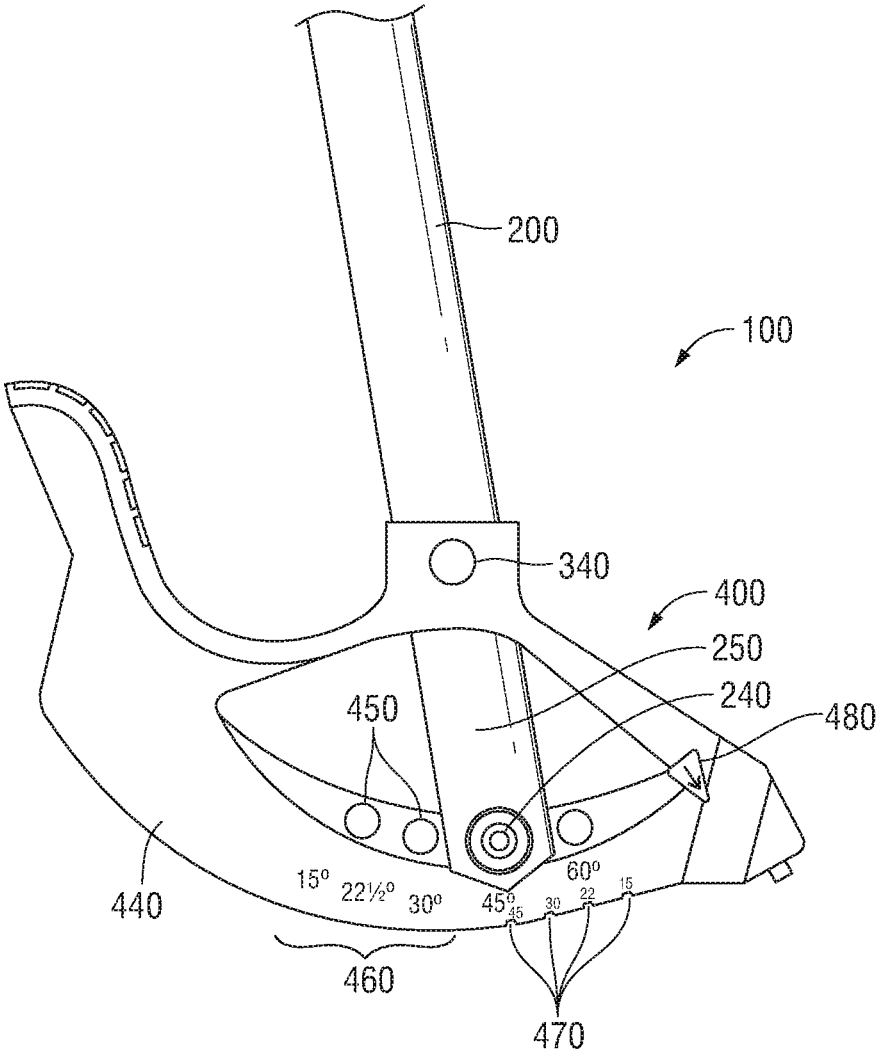
FIG. 9 is a perspective view of one end of another conduit bender provided in accordance with the present disclosure.

Turning to FIG. 9, another embodiment of a conduit bender provided in accordance with the present disclosure is shown generally identified by reference numeral 100. Conduit bender 100 includes a rotary lever 200 and a head assembly 400. Conduit bender 100 is similar to conduit bender 10 (FIG. 1) and may include any of the features thereof, and vice versa. In particular, conduit bender 100 may incorporate markings such as those detailed above to enable marking the conduit to be bent without additional devices, instruments, or calculations. Accordingly, only the components and features necessary to understand the differences between conduit bender 100 and conduit bender 10 (FIG. 1) are shown and detailed hereinbelow.

Conduit bender 100 differs from conduit bender 10 (FIG. 1) in that, rather than providing a rotary assembly 30 with disks 36, 38 (see FIG. 7), conduit bender 100 includes a swivel pin 340 that pivotably couples head 440 of head assembly 400 and rotary lever 200. Rotary lever 200 includes a spring loaded captive pin 240 disposed at the head end 250 thereof. Spring loaded captive pin 240 is releasably engagable within any one of a series of apertures 450 defined through head 440 of head assembly 400 to lock rotary lever 200 in fixed position relative to head assembly 400 and a desired anticipated bend angle. Markings 460 provided on head 440 are disposed adjacent respective apertures 450 to enable a user to readily identify which aperture 450 to engage spring loaded captive pin 240 within to achieve the desired anticipated bend angle. Rotary lever 200 is permitted to pivot about swivel pin 340 and relative to head assembly 400 to a desired position when spring loaded captive pin 240 is disengaged from apertures 450.

Head 440 of conduit bender 100 further includes a mark 480, facilitating making 90 degree sub ups, that indicates the end of the bend, e.g., the point at which the bend has reached 90 degrees. Further, similar as above, head 440 includes indentation markings 470 that indicate the point on the conduit corresponding to the center of the bend for the particular angle of bend, e.g., 15 degrees, 22.5 degrees, 30 degrees, and 45 degrees. Additionally, markings may be provided on rotary lever 200 (similar as with markings 27, 28, 28*a*', 28*b*' (FIGS. 3A-3B)) so as to enable marking a conduit for an accurate 90 degree sub up bend without the need for additional instrumentation or calculations.

The use and function of conduit bender 100 may otherwise be similar to that detailed with respect to conduit bender 10 (FIG. 1).

Figure 10A:
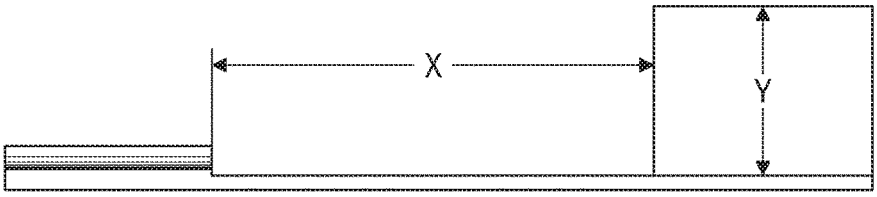
FIGS. 10A-10G illustrate methods of use of the conduit benders of the present disclosure.

Turning to FIGS. 10A-10G, a method of using conduit bender 10 (FIG. 1) to make an offset bend on a conduit for navigating around an obstacle is detailed. This method may equally be used with conduit bender 100 (FIG. 9). FIG. 10A illustrates a scenario where a conduit is required to be bent to navigate around an obstacle that is spaced-apart a distance "X" from an object that has a height "Y."

Figure 10B:
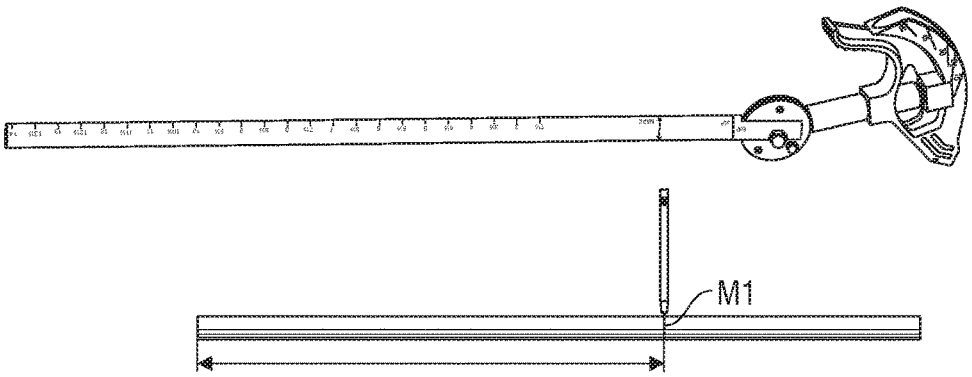

With reference to FIGS. 1 and 10B, in order to bend the conduit to navigate around the obstacle, it is first determined which bend angle is desired. Once the bend angle has been selected, the user orients rotary lever 20 such that the set of markings corresponding to that bend angle is in view. Next, the user marks on the conduit the position of the first mark 27 of the rotary lever 20. This serves as the first bend point.

Figure 10C:
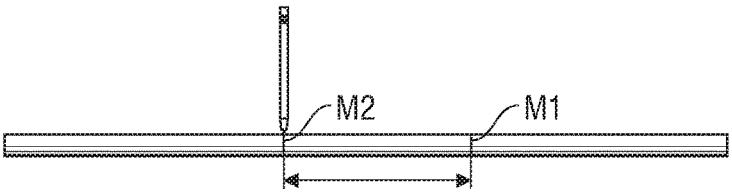

Turning to FIGS. 1 and 10C, once the first mark has been made, and without moving the conduit, the user marks the conduit at a second point, corresponding to the second bend point. The second mark is made according to the appropriate incremental marking 28 corresponding to the "distance to object." For example, where the "distance to object" is 48 inches, the second mark is made on the conduit at the 48 inch incremental marking 28 on the rotary lever 20.

Figure 10D:
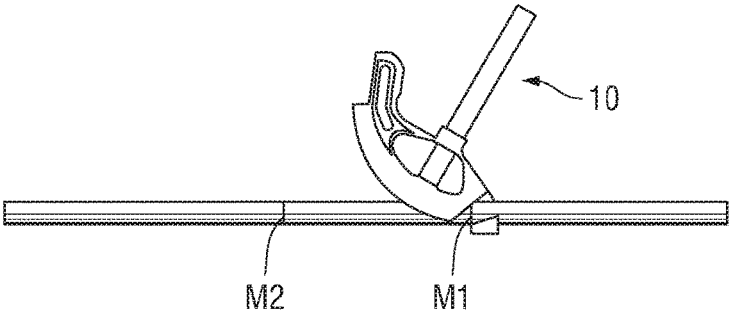
Figure 10E:
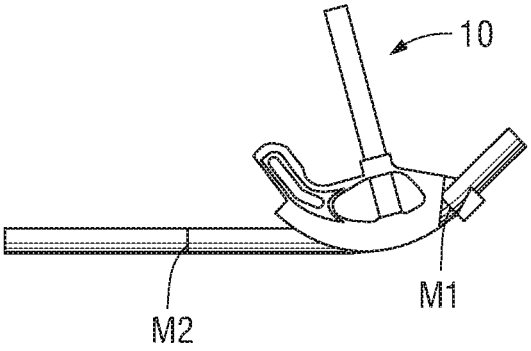
Figure 10F:
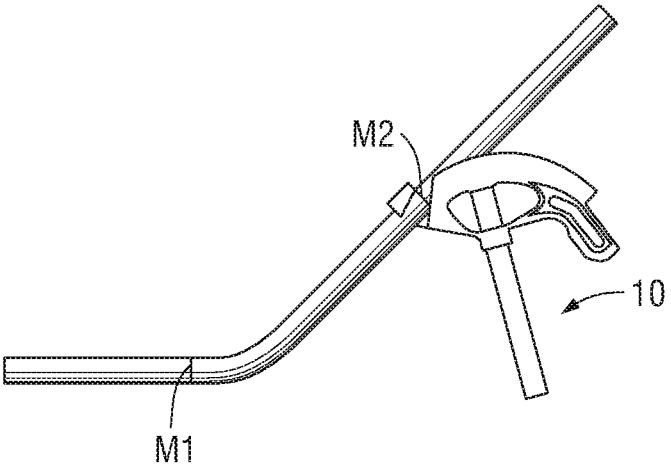
Figure 10G:
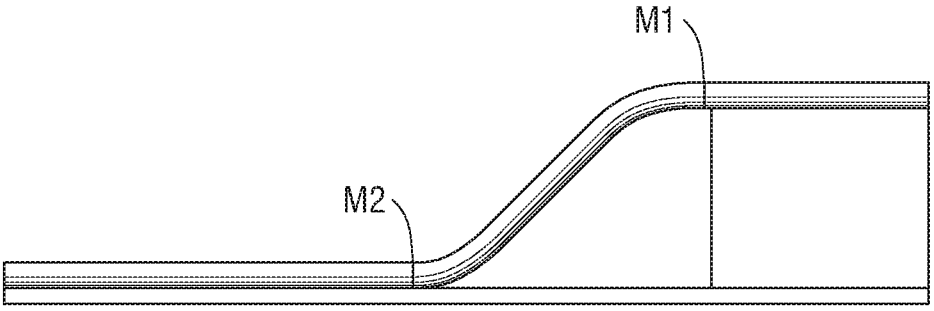

Turning to FIGS. 10D-10F, with the first and second marks having been made, the user may then bend the conduit at each mark to the appropriate bend angle, as detailed above. The result, as illustrated in FIG. 10G, is an offset bend that successfully traverses the obstacle.

It will be understood that various modifications could be made to the embodiments of the above disclosure. Therefore, the present description should not be construed as limiting, but merely as exemplifications of embodiments.

Those skilled in the art will envision other modifications within the scope and spirit of the present disclosure.

What is claimed is:

1. A conduit bender, comprising:

a lever defining a longitudinal axis and having a free end and a fixed end;

a head assembly configured to receive a conduit to be bent;

a rotary assembly operably coupling the fixed end of the lever to the head assembly such that the lever is pivotable relative to the head to a position corresponding to desired bend angle; and a level disposed at the free end of the lever and aligned on the longitudinal axis such that the level indicates a level condition when a conduit is bent to the desired bend angle.

2. The conduit bender according to claim 1, wherein the level is a spirit level disposed within the free end of the lever.

3. The conduit bender according to claim 1, wherein the lever includes at least one set of markings corresponding to a particular bend angle, wherein each set of markings includes a first mark and a plurality of incremental markings extending along at least a portion of a length of the lever, each set of markings configured to facilitate offset bending of a conduit to navigate around an object in accordance with the particular bend angle.

4. The conduit bender according to claim 3, wherein the lever includes at least two sets of markings, each set of markings corresponding to a different particular bend angle for offset bending.

5. The conduit bender according to claim 1, wherein the lever includes at least one set of markings corresponding to a particular saddle bend height, wherein each set of markings includes first, second, and third markings extending along at least a portion of a length of the lever, the first, second, and third markings configured to facilitate saddle bending of a conduit in accordance with the particular saddle bend height.

6. The conduit bender according to claim 1, wherein the head assembly includes an extending member and a head.

7. The conduit bender according to claim 1, wherein the head assembly defines a channel configured to receive a conduit to be bent.

8. The conduit bender according to claim 1, wherein the head assembly includes a shoe bender at a first end thereof and a receiver at a second end thereof.

9. The conduit bender according to claim 1, wherein the head assembly defines an arcuate configuration including angular indicator markings.

10. The conduit bender according to claim 1, wherein the head assembly includes indentation markings corresponding to a bend center for each of a plurality of bend angles.

11. A conduit bender, comprising:

a lever defining a longitudinal axis and having a free end and a fixed end; and a head assembly coupled to the fixed end of the lever, the head assembly configured to receive a conduit to be bent for bending the conduit, wherein the lever includes at least one first set of markings corresponding to a particular bend angle, wherein each set of markings includes a first mark and a plurality of incremental markings extending along at least a portion of a length of the lever, each set of markings configured to facilitate offset bending of a conduit to navigate around an object in accordance with the particular bend angle, and wherein the lever includes at least one second set of markings corresponding to a particular height saddle bend, wherein each set of markings includes first, second, and third markings extending along at least a portion of a length of the lever, each set of markings configured to facilitate saddle bending of a conduit to the particular height saddle bend.

12. The conduit bender according to claim 11, wherein the lever includes at least two first sets of markings, each first set of markings corresponding to a different particular bend angle.

13. The conduit bender according to claim 11, wherein the lever includes at least two second sets of markings, each second set of markings corresponding to a different particular height saddle bend.

14. The conduit bender according to claim 11, further comprising a rotary assembly operably coupling the fixed end of the lever to the head assembly such that the lever is pivotable relative to the head to a position corresponding to a desired bend angle.

15. The conduit bender according to claim 14, further comprising a level disposed at the free end of the lever and aligned on the longitudinal axis such that the level indicates a level condition when a conduit is bent to the desired bend angle.

16. The conduit bender according to claim 15, wherein the level is a spirit level disposed within the free end of the lever.

17. The conduit bender according to claim 11, wherein the head assembly defines a channel configured to receive a conduit to be bent.

18. The conduit bender according to claim 11, wherein the head assembly includes a shoe bender at a first end thereof and a receiver at a second end thereof.

19. The conduit bender according to claim 11, wherein the head assembly defines an arcuate configuration including angular indicator markings.

20. The conduit bender according to claim 11, wherein the head assembly includes indentation markings corresponding to a bend center for each of a plurality of bend angles.

* * * * *